US008634742B2

(12) United States Patent
Dobbertin

(10) Patent No.: US 8,634,742 B2
(45) **Date of Patent: *Jan. 21, 2014**

(54) AIRFLOW MANAGEMENT SYSTEM FOR CORONA CHARGER

(75) Inventor: Michael Thomas Dobbertin, Honeoye, NY (US)

(73) Assignee: Eastman Kodak Company, Rochester, NY (US)

( * ) Notice: Subject to any disclaimer, the term of this patent is extended or adjusted under 35 U.S.C. 154(b) by 118 days.

This patent is subject to a terminal disclaimer.

(21) Appl. No.: 13/278,762

(22) Filed: Oct. 21, 2011

(65) Prior Publication Data

US 2013/0101307 A1 Apr. 25, 2013

(51) Int. Cl.
*G03G 21/20* (2006.01)

(52) U.S. Cl.
USPC ..... 399/92; 399/91

(58) Field of Classification Search
USPC ..... 399/92, 98
See application file for complete search history.

(56) References Cited

U.S. PATENT DOCUMENTS

| | | | | |
|---|---|---|---|---|
| 5,128,720 | A | 7/1992 | Creveling | |
| 5,132,731 | A | 7/1992 | Oda | |
| 5,146,279 | A | 9/1992 | Seyfried | |
| 5,202,735 | A | 4/1993 | Thayer | |
| 5,424,540 | A | 6/1995 | Garcia et al. | |
| 5,697,018 | A | 12/1997 | Thomas et al. | |
| 6,038,120 | A | 3/2000 | May et al. | |
| 6,075,956 | A * | 6/2000 | Watanabe et al. | 399/92 |
| 6,385,414 | B1 | 5/2002 | Sato et al. | |
| 6,397,024 | B1 * | 5/2002 | Rejewski et al. | 399/92 |
| 6,453,147 | B1 | 9/2002 | Morse et al. | |
| 6,892,047 | B1 | 5/2005 | Giannetti et al. | |
| 7,174,114 | B2 | 2/2007 | Gila et al. | |
| 7,231,163 | B2 * | 6/2007 | Gopalanarayanan et al. | 399/98 |
| 7,957,677 | B2 * | 6/2011 | Miyata | 399/253 |
| 2011/0064449 | A1 | 3/2011 | Shimizu | |

FOREIGN PATENT DOCUMENTS

JP 2002-365987 A * 12/2002 ..... G03G 21/00

* cited by examiner

*Primary Examiner* — Clayton E Laballe
*Assistant Examiner* — Jas Sanghera
(74) *Attorney, Agent, or Firm* — David A. Novais; Roland R. Schindler, II

(57) ABSTRACT

Airflow management systems for a charger support area having a charger housing supporting a corona charger that is proximate to a primary imaging member are provided. In one embodiment an air flow management system has an air supply providing flow of air proximate an inlet side of the charger housing area and a deflection surface positioned to deflect the flow of air from a first direction to a second direction leading to an impact surface against which the flow of air is disbursed. The impact surface is outside of the width of the charger housing and the primary imaging member so that the air flow can supply a volume of disbursed air into the charger housing area that is sufficient to create a pressure that causes the disbursed air to move to an outlet on an opposite side of the area without exposing the charger or the primary imaging member to the flow.

13 Claims, 4 Drawing Sheets

AIRFLOW MANAGEMENT SYSTEM FOR CORONA CHARGER

CROSS REFERENCE TO RELATED APPLICATIONS

This application relates to commonly assigned, copending U.S. application Ser. No. 13/278,779, filed Oct. 21, 2011, entitled: "AIRFLOW MANAGEMENT METHOD FOR CORONA CHARGER" hereby incorporated by reference.

FIELD OF THE INVENTION

The present invention pertains to the field of printing.

BACKGROUND OF THE INVENTION

In many electrophotographic printers, corona chargers are used to impart a charge to a photoconductive film which is subsequently passed to an imaging section, a developing section and an image transfer section where the image on the photoconductor surface is transferred to a paper to produce a copy of the image on the paper. The paper is subsequently passed to a fuser section where a toner image on the paper is fixed to the paper by elevated temperature and pressure in the fuser section. The photoconductive film then passes through a neutralization section and thereafter past a brush cleaner which removes contaminants from the photoconductive film prior to passing the photoconductor film back to the primary charging section.

Often such corona chargers make byproducts including heat, ozone and nitrous oxides and many electrophotographic printers provide air flow systems to help evacuate these byproducts from a region that is proximate to the corona charger.

However, electrophotographic processes can create a wide variety of airborne contaminants. These contaminants can include, but are not limited to, substances such as fuser oil, toner, toner dust particles, addenda, paper fragments and the like. These contaminants can react in the highly reactive plasma atmosphere surrounding the wires that form the corona charger and coat the corona charger thereby creating localized regions that interfere with the formation of a charging field. This can result in non-uniform charge deposition on a primary imaging member such as a photoreceptor. The non-uniform charging can create artifacts in the formation of an electrostatic latent image that will then be reflected as defects in the developed visible toner image. Other examples of such contaminants include particulate contaminants such as a airborne toner dust, carrier particles, paper dust, dust from the abrasion of machine components, and can also include vapor contamination including silicon oils vaporized by a fuser and acidic byproducts caused by the operation of the corona charger.

As is shown, for example, in U.S. Pat. No. 5,424,540, "Corona Charger Wire Tensioning Mechanism" issued Jun. 13, 1995 to Garcia, et al and U.S. Pat. No. 6,038,120, "AC Corona Charger With Buried Floor Electrode" issued Mar. 14, 2000 to May, et al., corona chargers typically include bare corona wires which are located between a grid electrode and a shield. These wires are relatively small in diameter and since they are highly charged, contact between these wires and such contaminants can create charger arcing or other conditions that can cause machine errors, create non-uniform charging or reduce charger life. Contaminants also present a hazard to the primary imaging member either by becoming directly entrained in the primary imaging member or by remaining on the primary imaging member and being introduced into other subsystems to cause damage to such subsystems.

Accordingly, in an electrophotographic printer, air flow intended to remove the byproducts of corona charge creation can cause such contaminants to impact against corona wires and/or the surface of the electrostatic imaging member. Examples of such systems include, U.S. Pat. No. 5,132,731 to Oda, which describes an image forming apparatus including a pair of guide plates below developing units and adjacent to a transfer portion, the transfer portion including a transfer charger and a separating charger each of which has a first slit to form first paths and each of the guide plates having at least one second slit to form a second path. The image forming apparatus further includes a suction fan so as to suck gas generated in the transfer portion through the first paths and atmosphere around developing device through the second path. However, it will be appreciated that this approach creates a suction that can drive contaminants so that they are entrained in a corona wire or a photoconductor.

U.S. Pat. No. 5,128,720 issued to Creveling on Jul. 7, 1992 describes another approach to removing such gases. In this patent, a collection device is provided for collecting contamination product and harmful gasses from the corona charger. The collection device comprises a duct located within the shell of the charger closely adjacent to the walls thereof. The duct defines a series of ports spaced along the duct in the longitudinal direction of the charger shell. A flow of air into the duct is provided to directly collect such gasses from the environment within the reproduction apparatus without allowing such contamination products to contact and contaminate the corona wire and shell.

Another approach to the control of such contamination is the control of the flow of such contamination from the sources of the contamination. This requires very close control of the environment around substantially every operating system in the electrophotographic printer and is not considered feasible.

Nevertheless, it is necessary that air around a corona charger be replaced relatively frequently.

SUMMARY OF THE INVENTION

Airflow management systems for a charger support area having a charger housing supporting a corona charger that is proximate to a primary imaging member are provided. In one embodiment an air flow management system has an air supply providing flow of air proximate an inlet side of the charger housing area and a deflection surface positioned to deflect the flow of air from a first direction to a second direction leading to an impact surface against which the flow of air is disbursed. The impact surface is outside of the width of the charger housing and the primary imaging member so that the air flow can supply a volume of disbursed air into the charger housing area that is sufficient to create a pressure that causes the disbursed air to move to an outlet on an opposite side of the area without exposing the charger or the primary imaging member to the flow.

DETAILED DESCRIPTION OF THE INVENTION

Figure 1:
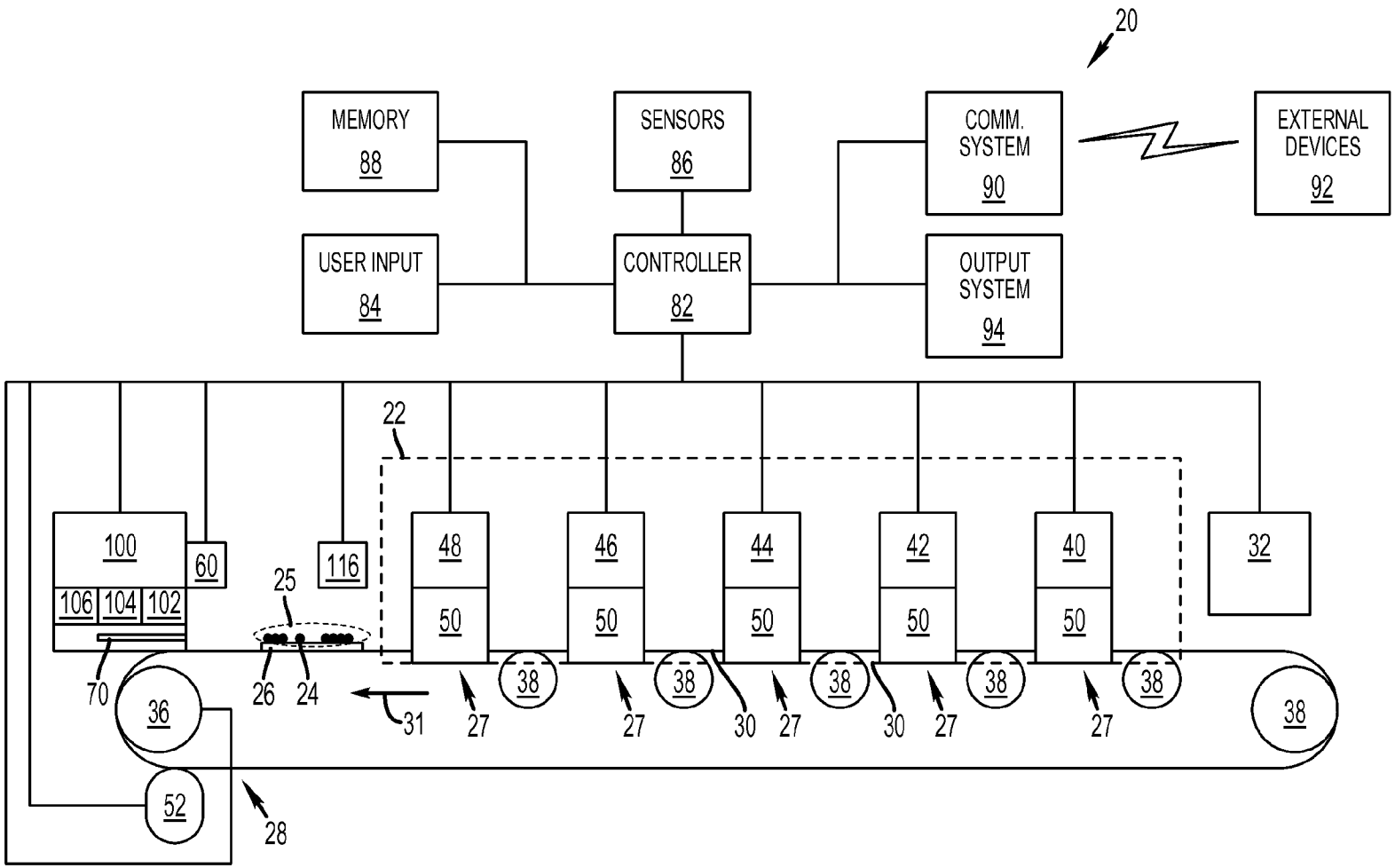
FIG. 1 shows a first embodiment of an electrophotographic printer.

FIG. 1 shows a first embodiment of an electrophotographic printer. FIG. 1 is a system level illustration of a toner printer 20. In the embodiment of FIG. 1, toner printer 20 has an electrophotographic print engine 22 that deposits toner 24 to form a toner image 25 in the form of a patterned arrangement of toner stacks. Toner image 25 can include any patternwise application of toner 24 and can be mapped according to data representing text, graphics, photo, and other types of visual content, as well as patterns that are determined based upon desirable structural or functional arrangements of the toner 24.

Toner 24 is a material or mixture that contains toner particles, and that can form an image, pattern, or coating when electrostatically deposited on an imaging member including a photoreceptor, photoconductor, electrostatically-charged, or magnetic surface.

Typically, receiver 26 takes the form of paper, film, fabric, metal treated or metallic sheets or webs. However, receiver 26 can take any number of forms and can comprise, in general, any article or structure that can be moved relative to print engine 22 and processed as described herein. As is shown in FIG. 1, receiver 26 is moved along a transfer direction 31 by contact with surface 30 past print modules 40, 42, 44, 46 and 48, and their respective transfer systems 50 so that each module can generate a separate toner image that can be transferred onto receiver 26 as receiver 26 is moved along transfer direction 31.

Receiver transport system 28 comprises a movable surface 30 that positions receiver 26 relative to print engine 22 so that print engine 22 can deposit one or more applications of toner 24 to form toner image 25 on receiver 26. A toner image 25 formed from a single application of toner 24 can, for example, provide a monochrome image or layer of a structure. In this embodiment, movable surface 30 is illustrated in the form of an endless belt that is moved by motor 36, that is supported by rollers 38, and that is cleaned by a cleaning mechanism 52.

Print engine 22 can cause one or more toner images 25 to be transferred to a receiver 26 as receiver 26 is moved by receiver transport system 28 from receiver supply 32 to fuser 60.

Electrophotographic printer 20 is operated by a printer controller 82 that can take any known form of electronic, electro-optical or electro-mechanical control system that can control the operation of print engine 22 including but not limited to each of the respective printing modules 40, 42, 44, 46, and 48, receiver transport system 28, receiver supply 32 and transfer subsystem 50, to form a toner image 25 on receiver 26 and to cause fuser 60 to fuse composite toner image 25 on receiver 26 to form print 70 having toner image 25 fused thereto.

Printer controller 82 operates electrophotographic printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, magnetic, or optical sensors and other sensors known in the art that can be used to detect conditions in toner printer 20 or in the environment-surrounding toner printer 20 and to convert this information into a form that can be used by printer controller 82 in governing printing, fusing, finishing or other functions. Memory 88 can comprise any form of conventionally known memory devices including but not limited to optical, magnetic or other movable media as well as semiconductor or other forms of electronic memory. Communication system 90 can comprise any form of circuit, system or transducer that can be used to send signals to or receive signals from memory 88 or external devices 92 that are separate from or separable from direct connection with printer controller 82. Communication system 90 can connect to external devices 92 by way of a wired or wireless connection.

External devices 92 can comprise any type of electronic system that can generate signals bearing data that may be useful to printer controller 82 in operating toner printer 20.

As is shown in FIG. 1, toner printer 20 further comprises an optional finishing system 100. Finishing system 100 can be integral to printer 20 or it can be separate or separable from printer 20. In the illustrated embodiment finishing system 100 optionally includes a cutting system 102, a folding system 104, and/or a binding system 106.

Figure 2:
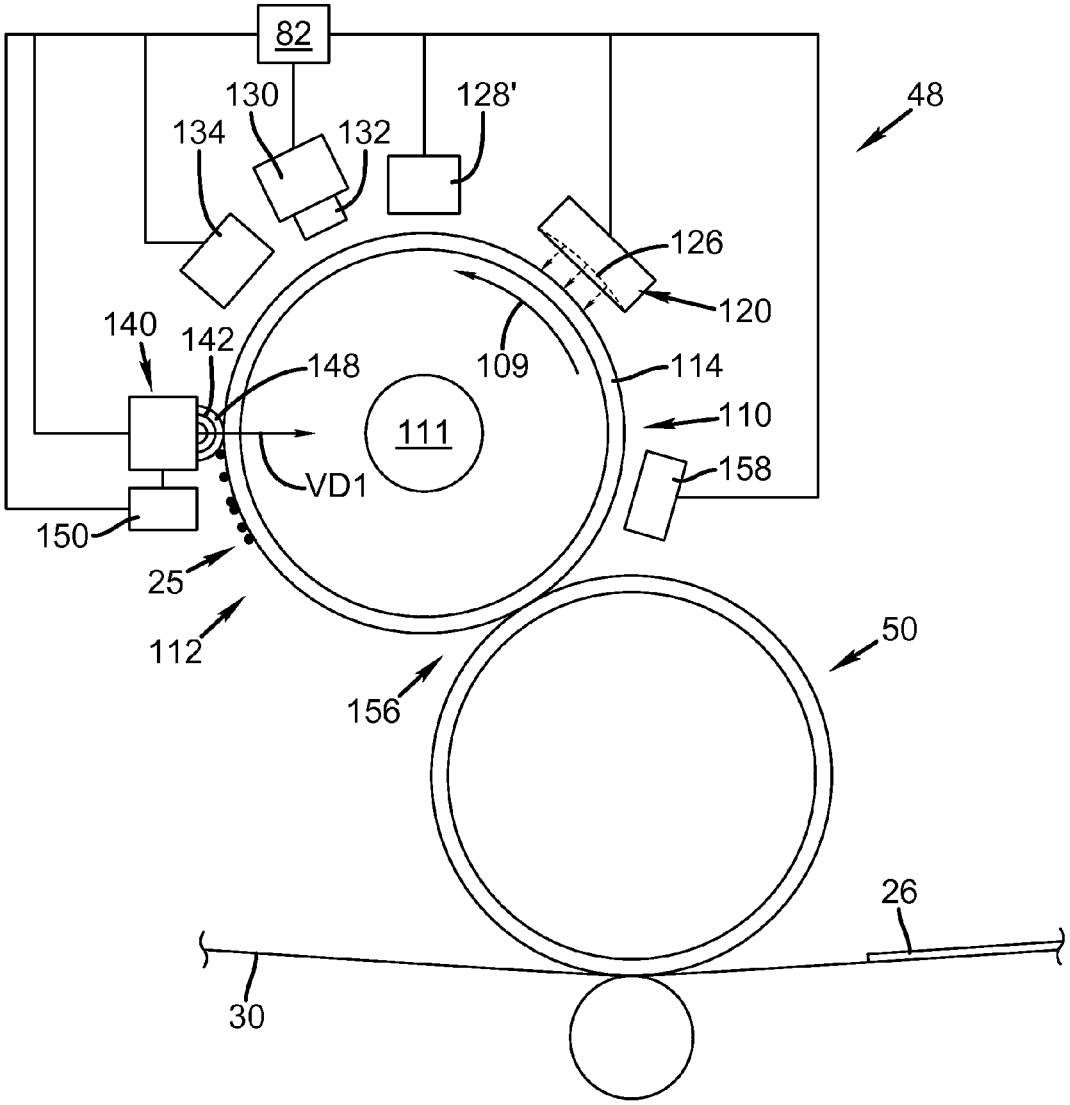
FIG. 2 shows a first embodiment of a charging system having a corona charger and an electrostatic imaging member.
Figure 3:
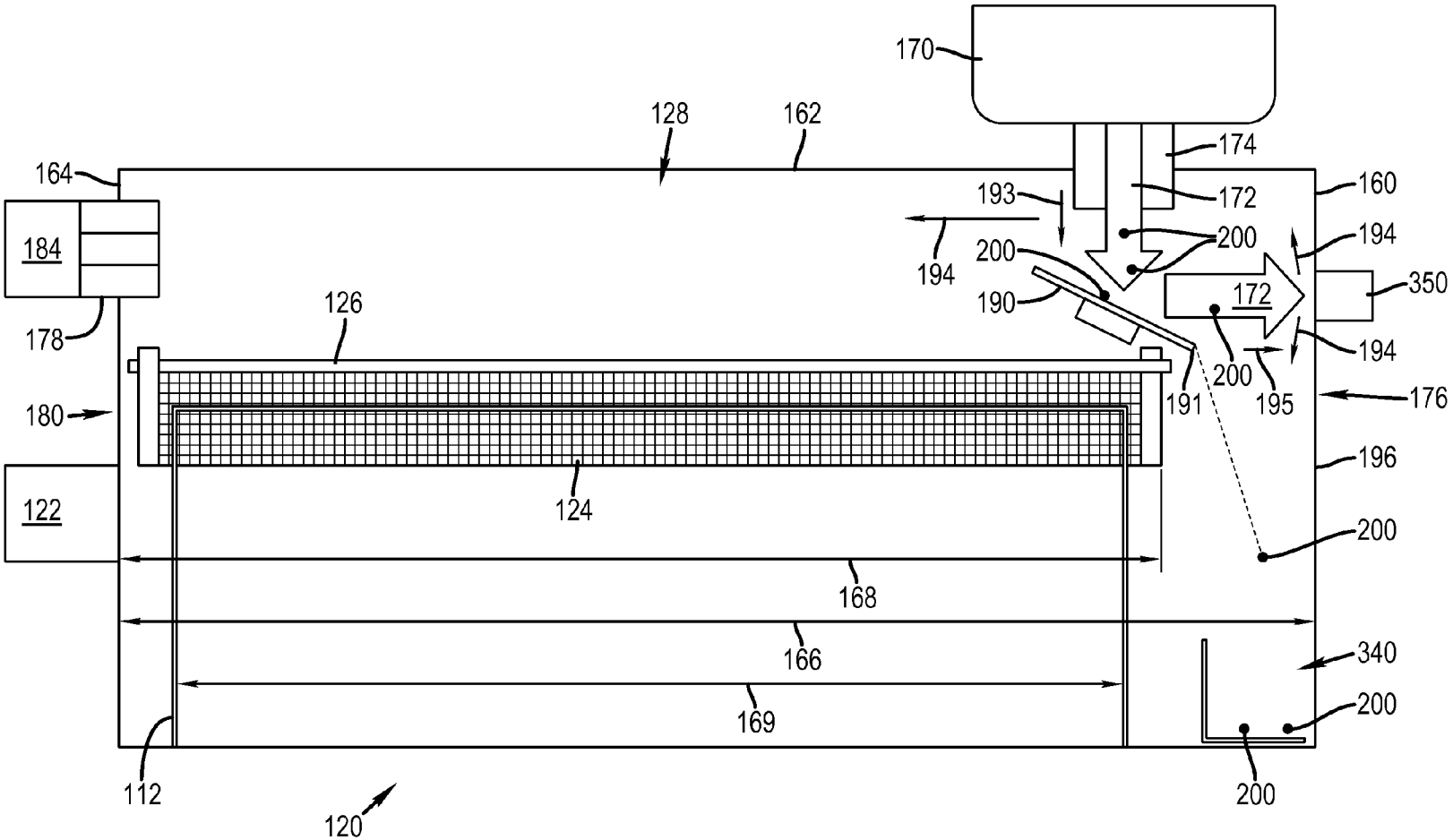
FIG. 3 shows one embodiment of a charging system in greater detail.
Figure 4:
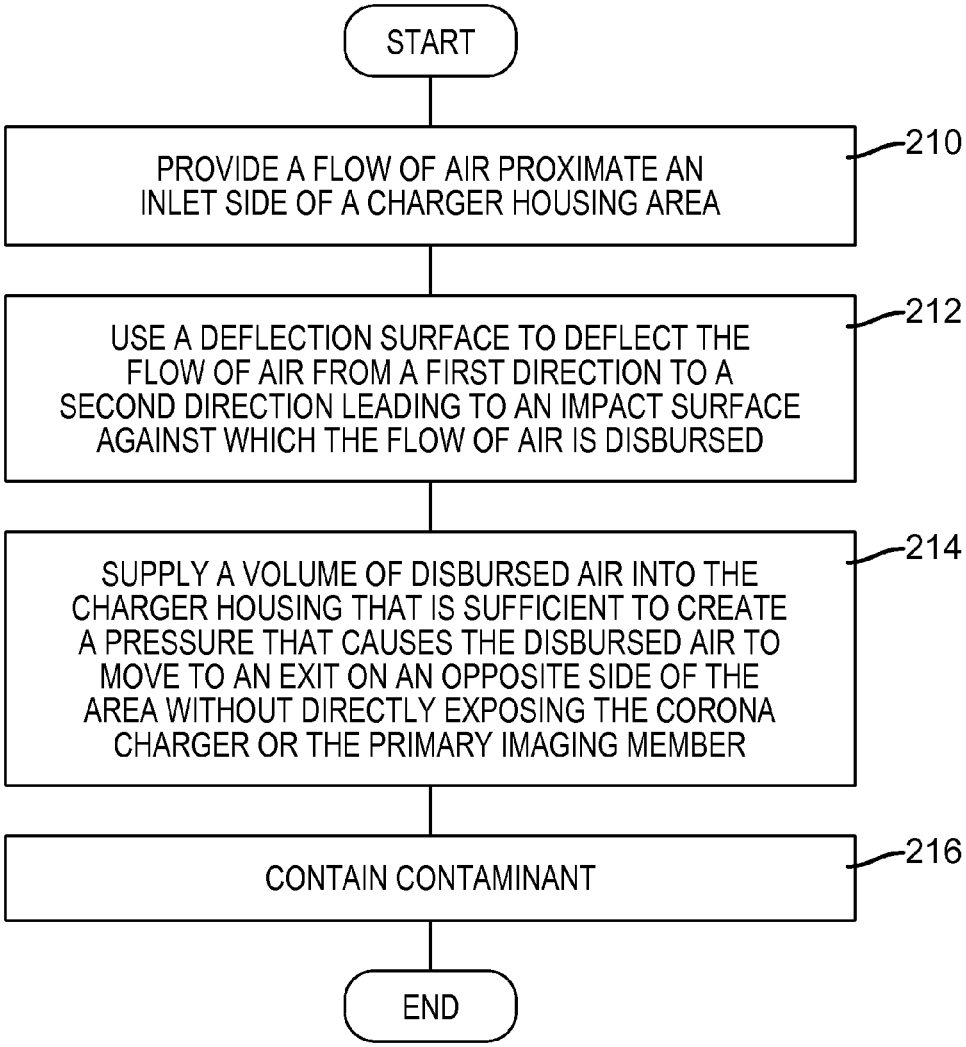
FIG. 4 shows a flow diagram of a first embodiment of a method for controlling air flow in a charging system.

FIG. 2 shows an example of a printing module 40 that is representative of printing modules 40, 42, 44, 46, and 48 of FIG. 1. In this embodiment, printing module 40 has a primary imaging system 110, a charging subsystem 120, a writing subsystem 130, and a first development station 140, each of which are ultimately responsive to printer controller 82. Primary imaging system 110 includes a primary imaging member 112. In the embodiment of FIGS. 2-4, primary imaging member 112 takes the form of an imaging cylinder. However, in other embodiments primary imaging member 112 can take other forms, such as a belt or plate. As is indicated by arrow 109 in FIG. 2, primary imaging member 112 is rotated by a motor 111 such that primary imaging member 112 rotates from charging subsystem 120, to writing subsystem 130 to first development station 140 and past a transfer nip 156 with a transfer subsystem 50, past a cleaning subsystem 158 and back to charging subsystem 120.

In the embodiment of FIG. 2, primary imaging member 112 has a photoreceptor 114. Photoreceptor 114 includes a photoconductive layer formed on an electrically conductive substrate. The photoconductive layer is an insulator in the substantial absence of light so that initial differences of potential Vi can be retained on its surface. Upon exposure to light, the charge of the photoreceptor in the exposed area is dissipated in whole or in part as a function of the amount of the exposure. In various embodiments, photoreceptor 114 is part of, or disposed over, the surface of primary imaging member 112.

Charging subsystem 120 is configured as is known in the art, to apply charge to photoreceptor 114. The charge applied by charging subsystem 120 creates a generally uniform initial difference of potential relative to ground on photoreceptor 114. In this embodiment, an optional meter 128' is provided that measures the electrostatic charge on photoreceptor 114 after initial charging and that provides feedback to, in this example, printer controller 82, allowing printer controller 82 to send signals to adjust settings of the charging subsystem 120 to help charging subsystem 120 to operate in a manner that creates a desired initial difference of potential Vi on photoreceptor 114. In other embodiments, a local controller or analog feedback circuit or the like can be used for this purpose.

Writing subsystem 130 is provided having a writer 132 that forms charge patterns on a primary imaging member 112 to form an electrostatic latent image. In this embodiment, this is done by exposing primary imaging member 112 to electromagnetic or other radiation that is modulated according to image data provided for printing module 40 by printer controller 82. The modulation of electromagnetic or other radiation causes primary imaging member 112 to have image modulated charge patterns thereon.

Development system 140 then exposes the latent electrostatic image to charged toner in the presence of an electromagnetic field created by power supply 150. This causes toner to develop against the primary imaging member 112 to form a toner image 25.

Further rotation of primary imaging member 112 brings toner image 25 into a transfer nip 156 where toner image 25 is transferred to a transfer system 50 from which toner image 25 can later be transferred onto receiver 26. Finally, primary imaging member 112 is cleaned by a cleaning system 140 and is returned to charging system 120.

FIG. 3 shows one embodiment of a charging system 120 in greater detail. As is shown in FIG. 3, charging system 120 has a power source 122 that supplies electrical energy to a corona charger 124 that is positioned proximate to primary imaging member 112 by a charger housing 126. Corona charger 124 and charger housing 126 are positioned in a corona charging area 128. In the embodiment of FIG. 3, charger housing area 128 generally encloses corona charger 124 and corona housing 126 and is generally defined by an inlet side wall 160, an inlet wall 162, an outlet side wall 164 and primary imaging member 112. As is shown in FIG. 3, charger housing area 128 has a width 166 that is greater than a width 168 of charger housing 126.

As is also shown in FIG. 3, an air supply 170 provides a flow 172 of air through an inlet 174 into charger housing area 128. As is shown in FIG. 3, inlet 174 is positioned proximate to an inlet side 176 of charger housing 126. As is also shown in FIG. 3, charger housing area 128 is also provided with an air outlet 178 that is positioned proximate an outlet side 180 of charger housing area 128 that is on a side of the charger housing 126 that is opposite from inlet side 176. As is also shown in FIG. 3, a deflector plate 190 is provided in charger housing area 128. As will be described in greater detail below, deflector plate 190 is positioned to intercept the flow 172 of air that is provided from inlet 174 into charger housing area 128.

FIG. 4 illustrates a first embodiment of a method for managing the air flow into a charger housing area 128 such as the charger housing area 128 that is illustrated in FIG. 3. To refresh the air in charger housing area 128, printer controller 82 causes air supply 170 to provide flow 172 of air proximate to inlet side 176 of charger housing 126. As is shown in FIG. 3, flow 172 is directed into charger housing area 128 from air supply 170 and is generally directed toward corona charger 124 and electrostatic imaging member 112.

However, it will be appreciated that introducing a flow 172 of air that is directed at either of a primary imaging member 112 or a corona charger 124 can create a risk that flow 172 will cause contaminants 200 to move therewith and be thrust against corona charger 124 and primary imaging member 112.

Contaminants 200 that are advanced by flow 172 gain momentum as they are advanced by flow 172. Importantly, larger contaminants 200 on the order of 100 to 3000 microns can develop significant momentum while moved by flow 172. Such particles can gain additional momentum where such contaminants 200 are electrostatically attracted to primary imaging member 112 or to corona charger 124.

Where contaminants 200 are allowed to directly impact primary imaging member 112 or corona charger 124 with a high momentum such direct impact can cause contaminants 200 to become entrained in primary imaging member 112 or in corona charger 124. Entrained contaminants 200 can permanently alter the surfaces that they impact. This can change both the physical and electrostatic properties of primary imaging member 112 and corona charger 124. Further, such entrained particles can be difficult to remove, creating the risk that conventional efforts to clean primary imaging member 112 or corona charger 124 will interact with entrained contaminants 200 in a way that further damages primary imaging member 110 or corona charger 124.

In some situations contaminants 200 are created in air supply 170. For example, in some embodiments air supply 170 can provide a humidity controlled supply of air. In such situations, the process of humidification can cause salts or other materials that are present in a water that is used to humidify the air to precipitate out of the water and to form scaling or precipitate on one or more surfaces (not shown) within air supply 170 that lead to inlet 174. Under certain circumstances, the velocity of air flow provided by air supply 170 can dislodge such scaling and precipitate to dislodge from such surfaces and to enter into flow 172 of air as contaminant 200.

In other cases, contaminants 200 such as toner particulates, paper particles oil droplets or agglomerates and the like may enter or be created in the air within charger housing area independent of flow 172. For example, the electrostatic fields provided by a charged primary imaging member 112 or an active corona charger 124 or can attract contaminants such as dirt, dust, toner particles, fragments of toner particles, oils into charger housing. If such contaminants 200 are present in areas of the charger housing area 128 that are proximate to flow 172 of air, such contaminants 200 can be drawn into and move with flow 172.

Accordingly, as is shown in FIG. 4, in a first step of the method a flow of air proximate an inlet side of a charger housing area is provided (step 210) and a deflection surface 192 is provided to deflect the flow 172 of air from a first direction 193 to a second direction 195 leading to an impact surface 196 against which the flow 172 of air is disbursed (step 212.) As is shown in FIG. 3, deflection surface 190 is positioned, as noted above, to intercept flow 172 of air and is arranged to deflect flow 172 toward impact surface 196 which, here is shown as taking the form of a portion of inlet side wall 160.

As is also shown in FIG. 3, when deflected flow 172 of air strikes impact surface 196, flow 172 is disbursed into fractions 194 of flow 172. Fractions 194 can travel in many directions relative to second direction 195. Generally speaking such fractions will travel at lower velocities than flow 172.

As is further shown in FIG. 3, impact surface 196 is outside of width 168 of charger housing 126 and a width of primary imaging member 169 so that flow 172 of air introduces a volume of disbursed air 194 in charger housing area 128 that creates a pressure proximate to the inlet side 176 of charger housing area 128 that is sufficient to cause the disbursed air 194 to move to outlet side 178 of charger housing without directly exposing primary imaging member 112 or corona charger 124 to flow 172 and the attendant risk of entrainment of large particles in these critical components (step 214).

In one embodiment, the air pressure at inlet side 176 that is greater than a pressure at outlet 178 which is maintained at atmospheric pressures. In other embodiments, an optional pressure control system 184 (shown in phantom) can be supplied to control pressure at outlet 178 to enhance movement of disbursed air 194 from inlet side 176 to outlet side 180. This can be used to ensure that the ultimate flow rate achieved does not exceed a rate that will again create a risk of contaminant entrainment problems. In this regard, pressure control system 184 can comprise a vacuum system or a system that has a valve or other control area that requires a predetermined amount of pressure to release air from charger housing area 128.

In one embodiment, a first direction 193 of an amount of flow 172 of air, an extent of the deflection provided by deflection surface 190 to define second direction 195 and an extent of disbursement caused by impact surface 196 can be combined to cause disbursed air 194 to move from impact surface 196 to exit 178 at rate that does not develop sufficient momentum in any airborne contaminant 200 to allow such contaminant 200 to become entrained in primary imaging member 112 or in corona charger 124.

In another embodiment, any or all of a first direction 193 of and an amount of flow 172 of air, an extent of the deflection provided by deflection surface 190 to define second direction 195 and an extent of disbursement caused by impact surface 196 can be combined to cause disbursed air 194 to move from impact surface 196 to exit 178 at rate that that is less than a rate that will lift any contaminant 200 that is above a threshold particle diameter so that the contaminant 200 can travel with the moving disbursed air. In one example of this type, a direction of and an amount of flow 172 of air, an extent of the deflection provided by deflection surface 190 and an extent of disbursement caused by impact surface 196 can be combined to cause disbursed air 194 to move from impact surface 196 to exit 178 at a velocity that is less than a velocity that will lift any contaminant 200 that could potentially be entrained in primary imaging member 112 or corona charger 124 such as salt particles that are above about 100 microns in diameter.

As is also shown in FIG. 4, the optional step of containing contaminate 200 from flow 172 can be performed (step 216). As is shown in FIG. 3 contaminants 200 that are advanced by flow 172 are directed into contact with deflecting surface 190 and impact surface 196. Such contact can have any of several outcomes that can help to remove contaminant 200 from flow 172 so that there is a reduced contaminant load in disbursed air 194.

For example, an impact between a contaminant 200 and a deflecting surface 190 can cause a change in velocity of contaminant 200 along the first direction 193. This requires that sufficient energy is applied to contaminant 200 to cause this change in velocity. In one embodiment, deflection surface 190 can be made from materials that have a hardness that causes contaminant 200 to be deflected from the first direction 193 generally along the second direction 195 to travel toward impact surface 196. In other embodiments, deflection surface 190 can have a resiliency that causes contaminant 200 to be thrust in the second direction.

As is shown in FIG. 3, a lower edge 191 of defection surface 190 extends beyond the charger housing 126 so that any contaminate 200 propelled by the air flow 172 that is deflected by deflection surface 190 will be advanced away from charger housing 126 and primary imaging member 112.

In still another embodiment, shown in phantom in FIG. 3, a circuit 350 can be provided that creates an electric field proximate to impact surface 196 to help achieve a deflection of contaminant 200. Circuit 350 can comprise for example a direct current power supply or an alternating current power supply as desired to achieve such redirection In an alternative embodiment, deflection surface 190 can be made of materials or electrically charged to capture or to entrain contaminants propelled by the flow 172. For example, deflection surface 190 can comprise a material that is plastically deformable when impacted by contaminants 200 that are within a particular size range so as to absorb such contaminants or to absorb sufficient energy from such contaminants 200 to allow contaminants 200 to remain on deflection surface 190. In another example deflection surface 190 can have a circuit 350 that is used to electrostatically hold contaminants 200 against deflection surface 190 so as to help adhere the contaminants to the deflection surface 190.

In still another embodiment, deflection surface 190 can be made of materials and/or be used with a circuit 350 that can remove sufficient momentum from contaminants 200 to allow contaminants 200 to roll off of deflection surface 190 and into a containment area such as area 340 shown in FIG. 3. Containment area 340 can optionally include a circuit 350 that creates an electrostatic field to attract contaminants 200 therein.

Similarly, impact surface 196 can take any number of forms. As is shown in FIG. 3 contaminants 200 that are advanced by flow 172 along second direction 195 are directed into contact with deflecting surface 190 and impact surface 196. Such contact can have any of several outcomes that can help to remove contaminant 200 from flow 172 so that there is a reduced contaminant load in disbursed air 194.

For example, an impact between a contaminant 200 and impact surface 196 will cause a change in velocity of contaminant 200 along second direction 195. This requires that sufficient energy is applied to contaminant 200 to cause this change in velocity. In one embodiment, deflection surface 190 can be made from materials that have a hardness that causes contaminant 200 to be stopped from further movement in second direction 195. This eliminates the momentum that keeps contaminant 200 moving with flow 172 and allows gravity to draw contaminants 200 to fall into containment area 340.

Optionally impact surface 196 can be adapted with surface features that help to prevent contaminant 200 from ricocheting away from impact surface 196 and back toward primary imaging member 112 and corona charger 124. These can include energy absorbing materials such as resilient materials that can receive and absorb the energy of an impact with contaminant 200 by temporarily deforming, or plastically deformable materials that will absorb some of the energy through deformation.

In still another embodiment, shown in phantom in FIG. 3, a circuit 350 can be provided that creates an electric field proximate to impact surface 196 to help absorb the impact energy from a contaminant 200. Circuit 350 can comprise for example a direct current charge power supply or an alternating current power supply as desired to achieve such redirection.

In an alternative embodiment, impact surface 196 can be made of materials or electrically charged to capture or to entrain contaminant 200 propelled by flow 172. For example, deflection surface 190 can comprise a material that is plastically deformable when impacted by contaminant 200 that are within a particular size range so as to absorb contaminant 200 or to absorb sufficient energy from such contaminant 200 to allow contaminant 200 to remain on deflection surface 190. In another example impact surface 196 can have a circuit 350 that is used to electrostatically hold contaminant 200 against deflection circuit.

It will be appreciated that access to charger housing area 128 is frequently required for maintenance and service. Accordingly, in one embodiment, the impact surface 196 can comprise a surface of an access door that can be opened. Similarly, in such an embodiment the containment area 340 can be a feature that is provided in the access door.

The invention claimed is:

1. An airflow management system for a charger support area having a charger housing supporting a corona charger that is proximate to a primary imaging member comprising:

an air supply providing flow of air proximate an inlet side of a charger housing area; and a deflection surface positioned to deflect the flow of air from a first direction to a second direction leading to an impact surface against which the flow of air is disbursed;

wherein the impact surface is outside of a width of the charger housing and the primary imaging member so that the air flow can supply a volume of disbursed air into the charger housing area that is sufficient to create a pressure that causes the disbursed air to move to an outlet on an opposite side of the charger housing area without directly exposing the charger or the primary imaging member to the flow; and wherein the disbursed air moves across from the impact surface to the outlet at a rate that is insufficient to entrain airborne particles that could cause damage to the charger or to the primary imaging member.

2. The system of claim 1, wherein at least one of the deflection surface and the impact surface has a surface that is made from a material that can entrain contaminates propelled by the air flow.

3. The system of claim 1, wherein a lower edge of the deflection surface extends beyond the charger housing so that any contaminate propelled by the provided air flow that is deflected will be advanced away from the charger housing and the primary imaging member.

4. The system of claim 1, further comprising a containment area wherein the containment area is positioned to receive at least one of contaminate that is deflected by the deflection surface and contaminant that impacts the impact surface.

5. The system of claim 4, wherein the deflection surface is arranged to deflect any contaminant propelled by the air flow toward the containment area.

6. The system of claim 1, wherein the impact surface is made using a material in which contaminant can be entrained.

7. The system of claim 1, further comprising a containment area adapted to generate at least one of an electrostatic or electromagnetic force that attracts contaminant into the containment area.

8. The system of claim 1, wherein the impact surface is a movable access door.

9. The system of claim 1, wherein the impact surface is a movable access door having a containment area integrally formed therewith.

10. The system of claim 1, further comprising a circuit providing an electric field that either attracts a contaminant to the deflection surface or deflects a contaminant from the deflection surface.

11. The system of claim 1, further comprising a circuit providing an electric field that attracts a contaminant to the impact surface or deflects a contaminant from the impact surface.

12. An airflow management system for a charger support area having a charger housing supporting a corona charger that is proximate to a primary imaging member, comprising:

an air supply providing flow of air proximate an inlet side of a charger housing area; and a deflection surface positioned to deflect the flow of air from a first direction to a second direction leading to an impact surface against which the flow of air is disbursed;

wherein the impact surface is outside of a width of the charger housing and the primary imaging member so that the air flow can supply a volume of disbursed air into the charger housing area that is sufficient to create a pressure that causes the disbursed air to move to an outlet on an opposite side of the charger housing area without directly exposing the charger or the primary imaging member to the flow; and wherein the disbursed air moves at a velocity that is less than a velocity that will lift any contaminant particles that are above a threshold particle diameter.

13. An airflow management system for a charger support area having a charger housing supporting a corona charger that is proximate to a primary imaging member, comprising:

an air supply providing flow of air proximate an inlet side of a charger housing area; and a deflection surface positioned to deflect the flow of air from a first direction to a second direction leading to an impact surface against which the flow of air is disbursed;

wherein the impact surface is outside of a width of the charger housing and the primary imaging member so that the air flow can supply a volume of disbursed air into the charger housing area that is sufficient to create a pressure that causes the disbursed air to move to an outlet on an opposite side of the charger housing area without directly exposing the charger or the primary imaging member to the flow; and wherein the disbursed air moves at a velocity that is less than a velocity that will lift any contaminant particles that are above about 100 microns in diameter.

* * * * *